United States Patent [19]

Ruby

[11] Patent Number: 4,939,423

[45] Date of Patent: Jul. 3, 1990

[54] REDUCTION OF EFFECTS OF BEAT FREQUENCIES IN SYSTEMS WITH MULTIPLE OSCILLATORS

[75] Inventor: Joseph H. Ruby, Glendale, Ariz.

[73] Assignee: Honeywell Inc., Minneapolis, Minn.

[21] Appl. No.: 280,493

[22] Filed: Dec. 6, 1988

[51] Int. Cl.[5] ..... H05B 37/00

[52] U.S. Cl. ..... 315/105; 315/174; 315/226; 331/40

[58] Field of Search ..... 315/105, 174, 226, DIG. 2, 315/DIG. 4, DIG. 5; 331/40, 41

[56] References Cited

U.S. PATENT DOCUMENTS 4,791,337 12/1988 Murata ..... 315/169.1

*Primary Examiner*—Robert J. Pascal

*Attorney, Agent, or Firm*—Kinney & Lange

[57] ABSTRACT

Apparatus for reducing the effects of beat frequencies in systems having multiple oscillators wherein a wide band frequency modulator operates to alter the frequency supplied by one of the oscillators at a rate high enough that any beat frequencies occur at rates undetectable to the human eye.

16 Claims, 1 Drawing Sheet

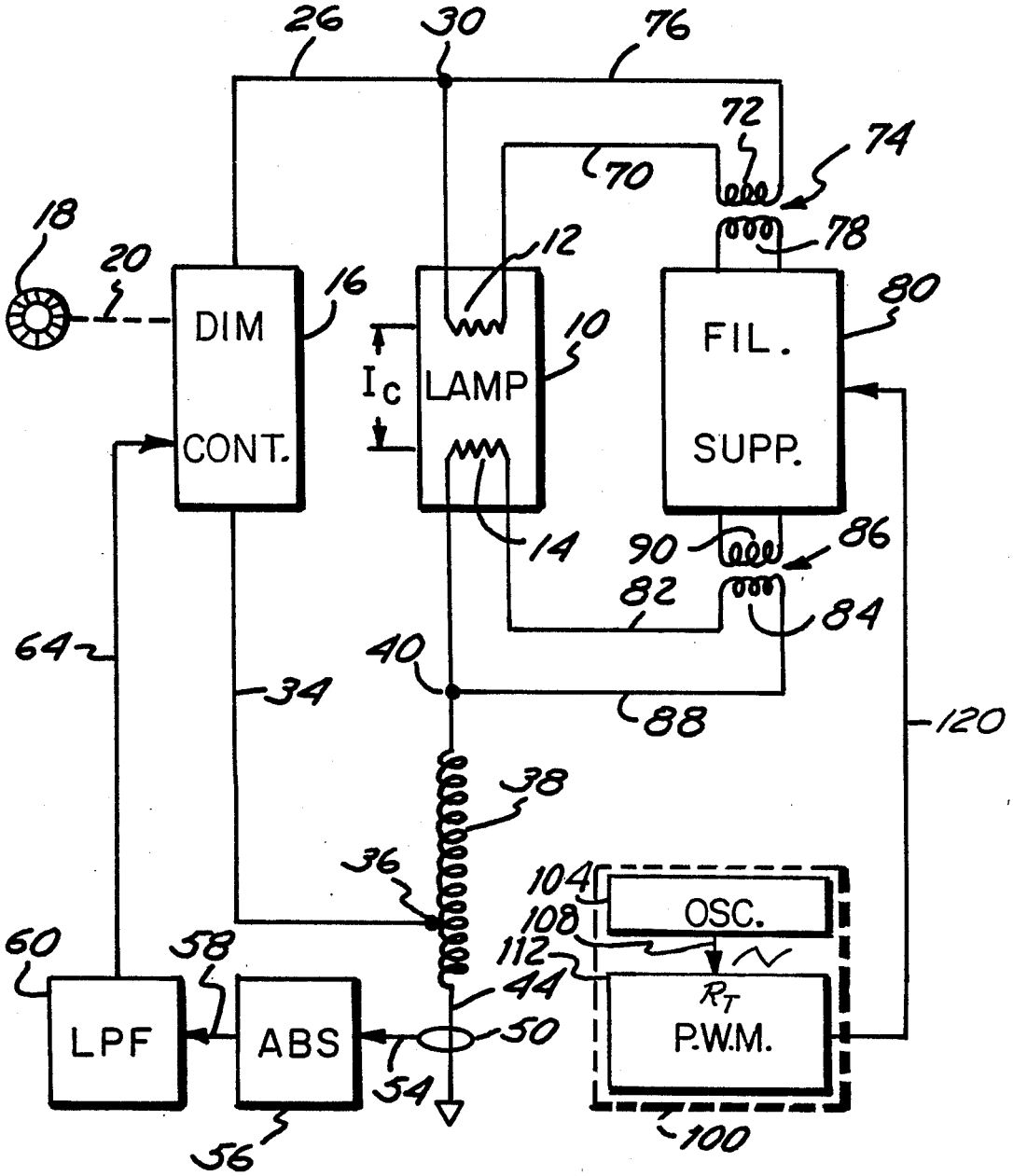
26
30
76
72
74
70
18
20
12
78
DIM
16
10
80
FIL.
$I_C$
LAMP
CONT.
SUPP.
14
90
86
82
84
64
40
34
88
120
38
36
104
OSC.
108
60
58
112
44
$R_T$
LPF
ABS
50
P.W.M.
54
56
100

REDUCTION OF EFFECTS OF BEAT FREQUENCIES IN SYSTEMS WITH MULTIPLE OSCILLATORS

BACKGROUND OF THE INVENTION

1. Field of the Invention

The present invention relates to apparatus for use in reducing beat frequency effects where more than one oscillator is employed in a system, particularly when one of the oscillators is variable in frequency.

2. Description of the Prior Art

In systems where more than one oscillator is employed, undesirable effects can occur when the frequencies or their harmonics are so related to one another that beat frequencies are produced. For example, in a co-pending application Ser. No. 280,482 entitled "Fluorescent Lamp Dimmer" filed by the applicant on even date herewith and assigned to the assignee of the present invention, a circuit is shown in which the pulse width and frequency of a source of energizing potential for a fluorescent lamp is varied under the control of an operator who desires to produce lamp dimming. The lamps have filaments which are independently energized from a filament supply which normally would be at a fixed frequency but wherein it has been found that the variable frequency under the operator's control can become close to or at the frequency of one of the harmonics of the fixed frequency with the result that a low beat frequency is produced which causes undesirable visible flicker in the lamp. Other apparatus such as CRT displays which may utilize a cathode ray tube and which may be energized from a low voltage power supply oscillator or which utilize a variable frequency oscillator in the backlight can produce "ocean wave" disturbances on the display screen because of harmonic beating between the power supply and the variable frequency oscillator or the horizontal and vertical line sync oscillator in the CRT.

In the prior art, where beat frequencies have caused problems, it is common practice to utilize filters to reduce the voltage coupling between the oscillators. While this may work satisfactorily with fixed frequency oscillators, it utilizes undesirable additional components, and does not work where one or more of the oscillators is of variable frequency because the point at which beat frequencies develop may change.

SUMMARY OF THE INVENTION

The present invention overcomes the beat frequency problem by utilizing a wide band frequency modulating source to change the frequency of one of the oscillators at a rate which is not detectable to the human eye. More specifically, in the case of the fluorescent lamp dimmer, by modulating the frequency which is used to energize the filaments of the lamp at a rate which makes any beat frequency encountered fall outside the pass band of the human eye (approximately 60 Hz) any flicker that is produced becomes invisible. In the case of the CRT, the present invention would cause the undesirable "ocean wave" images to move about at a rate which is undetectable to the human eye.

BRIEF DESCRIPTION OF THE DRAWINGS

The FIGURE shows a block circuit diagram of the present invention.

DETAILED DESCRIPTION OF THE PREFERRED EMBODIMENTS

The invention will be described in connection with the use thereof in a dimming circuit for a fluorescent lamp, as shown in the FIGURE, but it should be understood that the use of the present invention may be found anywhere that two or more oscillators produce a beat frequency which is undesirable.

In the FIGURE, which shows a circuit similar to that found in the above-mentioned co-pending application, a fluorescent lamp 10 having first and second filaments 12 and 14 is to be dimmed by a dimming control circuit 16 under the control of an operator through a knob 18 and a mechanical connection 20, all of which are better described in the above referred to co-pending application.

An output from the dimming control 16 on a conductor 26 presents a pulsating voltage to a junction point 30 connected to one side of the filament 12. The width of the pulses on conductor 26 and the frequency thereof is determined by the setting of the knob 18.

A second output from the dimming control 16 is presented on a conductor 34 to a tap 36 on an autotransformer winding 38, the upper end of which is connected to a junction point 40 that is connected to one end of the filament 14. The other end of autotransformer winding 38 is connected by a conductor 44 to signal ground. The signal on conductor 34 is a pulsating trigger voltage which, operating through autotransformer winding 38, produces a large potential difference between terminals 30 and 40 for a short period of time necessary to start the arc current $I_C$ flowing in the lamp between filaments 12 and 14. As soon as the trigger voltage disappears on conductor 34, the voltage at terminal 30 with respect to signal ground continues to cause the current $I_C$ to flow during each pulse on line 26.

A transformer winding 50 senses the arc current $I_C$ flowing through lamp 10 to signal ground and produces a voltage on a conductor 54 to an absolute value circuit 56 which operates to rectify the voltage and produce the rectified voltage on a conductor 58 to a low pass filter 60 which operates to produce a DC feedback voltage on a conductor 64 to the dimming control 16. When the arc current $I_C$ is at a value representing the desired amount of dimness, the voltage produced on line 64 will be of magnitude equal to the voltage produced by the knob 18 through mechanical connection 20 and no further change will occur.

The filaments 12 and 14 require a filament supply source in order to warm up and maintain the filaments in a condition for causing arc discharge in the lamp 10. Accordingly, the other end of filament 12 is shown connected by a conductor 70 to one end of a transformer secondary winding 72 of a transformer 74. The other end of winding 72 is connected by a conductor 76 to the junction 30. A primary winding 78 of transformer 74 is connected to a filament supply 80 which may be part of a standard circuit chip, i.e. an "SG1524B" referred to as a switch mode power supply manufactured by Silicon General. The supply 80 operates to produce a voltage to transformer 74 of magnitude necessary to bring filament 12 to operating temperature. Similarly, the other end of filament 14 is connected by a conductor 82 to one side of a transformer secondary winding 84 of a transformer 86. The other end of winding 84 is connected by a conductor 88 to junction point 40. A primary winding 90 of transformer 86 is connected to filament supply 80 and operates to supply the necessary voltage to filament 14.

With the above-described portion of the circuit, filament supply 80 would normally be of fixed frequency, for example 50 KHz. The dimming control 16 operates to produce a variable frequency on lines 26 and 34, which frequency may vary through a range, for example, 100 Hz to 25 KHz. As the operator begins to turn the knob 18 to cause dimming,

15 the frequency of the signal on lines 26 and 34 may therefore pass through, for example, 1.998 KHz which has a twenty-fifth harmonic at 49.95 KHz. The upper side band of the two frequencies 50.0 KHz and 49.95 KHz is 99.95 KHz which is far above the frequency of 60 Hz visible to the human eye but the lower side band is 50 Hz (50 KHz−49.95 KHz) which is just within the visible spectrum and, accordingly, this is seen by an observer as a visible flicker. The flicker will continue as the variable frequency increases to about 2.0 KHz which has 50 KHz as the twenty-fifth harmonic. The flicker disappears here because the lower side band becomes zero. The flicker reappears above 2.0 KHz to about 2.002 KHz which has a twenty-fifth harmonic at 50.05 KHz and again the lower side band of the frequency 50.0 KHz and 50.05 KHz will be 50 Hz and thus visible. The phenomenon occurs at other frequencies also, e.g. from about 4.995 KHz to 5.005 KHz which have a tenth harmonic at 49.95 KHz and 50.05 KHz respectively, and the lower side bands of the resulting frequency is again 50 Hz which is in the visible spectrum. Similarly, at 24.95 KHz, the second harmonic is 49.94 KHz so the lower sideband is 60 Hz which again produces an undesirable visible flicker.

To overcome this problem, the present invention utilizes a wide band FM modulator 100 consisting of an oscillator 104 which may be a standard circuit chip, i.e. an astable oscillator "LM556 Dual Timer", manufactured by National Semiconductor, having an output on line 108 which appears like an alternating increasing and decaying RC circuit at a frequency of, for example 150 Hz, as seen by the small waveform adjacent line 108. This signal is presented to a pulse width modulator 112 which again may be part of a standard circuit chip, i.e. the above-mentioned "SG1524B" which includes the filament supply 80, with the line 108 connected to its $R_T$ input. Modulator 112 produces a signal on an output conductor 120 connected to the filament supply 80. The 50 Khz signal on the two filament transformer secondaries 72 and 74 is a wide band frequency modulated signal that varies in frequency by an amount Δf which may be, for example, 5 KHz (45 Khz to 55 Khz) and the variation may be at a rate of, for example, 150 Hz.

In operation, the wide band FM modulator operates to change the frequency supplied by the filament supply 80 to the windings 78 and 90 by the amount 5 KHz and to cause the frequency to change back and forth 150 times a second. It should be noted that wide band frequency modulation is considered to be where the modulation index (Δf÷F) is greater than $\pi/2$, i.e. about 1.70. In the present case, with the modulator having a frequency change Δf equal to 5 KHz and changing at a frequency F of 150 Hz, the modulation index is $33\frac{1}{3}$, which is significantly greater than the 1.70 value.

With the signal to the lamp filaments varying in this manner, any flicker that occurs because of the beat frequencies in the oscillators is at such a high frequency (above 60 Hz) that the operator's eye cannot detect it and, accordingly, no difficulties are encountered. Similarly, in the case of the CRT displays, the "ocean wave" observation disappears because it moves about faster than the eye can detect.

Although the present invention has been described with reference to preferred embodiments, workers skilled in the art will recognize that changes may be made in form and detail without departing from the spirit and scope of the invention.

What is claimed is:

1. A method of reducing the effects of beat frequencies in a system having more than one source of oscillating energy comprising:

modulating at least one of the sources so that its oscillating energy changes frequency by an amount Δf and does so at a frequency F, Δf and F being chosen so that any beat frequency varies at a rate greater than that detectable by the human eye.

2. The method of claim 1 wherein the values for Δf and F are chosen so that any beat frequency is greater than about 60 Hz.

3. The method of claim 1 wherein the values for Δf and F are chosen so that Δf divided by F is greater than $\pi/2$.

4. The method of claim 3 wherein Δf is about 5.0 KHz and F is about 150 Hz.

5. The method of claim 1 wherein one of the sources is a variable frequency source.

6. The method of reducing flicker in a fluorescent lamp having a filament energized from a first source of oscillating voltage wherein a second source of oscillating voltage is used to provide dimming for the lamp comprising:

modulating the first source so that its voltage changes frequency by an amount Δf and at a rate F such that any beat frequency which may develop between the first and second sources is at an unnoticeable frequency.

7. Apparatus according to claim 6 wherein Δf and F are chosen so that any beat frequency produced is above 50 Hz so as not to be noticeable to the human eye.

8. The method according to claim 6 wherein the for Δf and F are chosen so that the ratio of Δf to F is greater than $\pi/2$.

9. The method or claim 8 wherein Δf is about 5.0 KHz and F is about 150 Hz.

10. The method of claim 6 wherein the second source varies in frequency to produce variable dimming of the lamp.

11. Apparatus to prevent visible effects of beat frequencies in a system having first and second oscillators comprising:

modulating means operable to produce a wide band output which changes frequency by an amount Δf at a rate F; and means connecting the modulating means to the first oscillator so as to change the output of the first oscillator by the amount Δf and at the rate F, Δf and F being chosen so that the beat frequencies change at a rate undetectable to the human eye.

12. Apparatus according to claim 11 wherein Δf divided by F is greater than 1.70.

13. Apparatus according to claim 11 wherein Δf is about 5.0 KHz and F is about 150 Hz.

14. Apparatus according to claim 11 wherein the system is a fluorescent lamp dimmer, the first oscillator is the filament supply and the second oscillator has a variable frequency of magnitude dependent on the amount of desired dimming.

15. Apparatus according to claim 14 wherein Δf divided by F is greater than 1.70.

16. Apparatus according to claim 14 wherein Δf is about 5.0 KHz and F is about 150 Hz.

* * * * *

UNITED STATES PATENT AND TRADEMARK OFFICE

CERTIFICATE OF CORRECTION

PATENT NO. : 4,939,423

DATED : July 3, 1990

INVENTOR(S) : Joseph H. Ruby

It is certified that error appears in the above-identified patent and that said Letters Patent is hereby corrected as shown below:

Col. 4, line 37, after "wherein the', insert --rates--

Col. 4, line 41, delete "or", insert --of--

Signed and Sealed this

First Day of October, 1991

Attest:

Attesting Officer

HARRY F. MANBECK, JR.

Commissioner of Patents and Trademarks